US005840474A

United States Patent [19]

Andriessen et al.

[11] Patent Number: 5,840,474

[45] Date of Patent: Nov. 24, 1998

[54] PREPARATION METHOD FOR (100) TABULAR SILVER HALIDE GRAINS RICH IN CHLORIDE IN SILICA SOL AS BINDER

[75] Inventors: Hieronymus Andriessen; Peter Verrept, both of Mortsel, Belgium

[73] Assignee: Agfa-Gevaert, N.V., Mortsel, Belgium

[21] Appl. No.: 715,499

[22] Filed: Sep. 18, 1996

Related U.S. Application Data

[60] Provisional application No. 60/007,950 Dec. 4, 1995.

[30] Foreign Application Priority Data

Oct. 2, 1995 [EP] European Pat. Off. ..... 95202639

[51] Int. Cl.[6] ..... G03C 1/035; G03C 1/015; G03C 1/07

[52] U.S. Cl. ..... 430/569; 430/567

[58] Field of Search ..... 430/569, 567

[56] References Cited

U.S. PATENT DOCUMENTS

| | | | |
|---|---|---|---|
| 5,320,938 | 6/1994 | House et al. | 430/569 |
| 5,476,761 | 12/1995 | Verbeeck et al. | 430/569 |
| 5,543,284 | 8/1996 | Verbeeck | 430/569 |
| 5,627,019 | 5/1997 | Vandenabeele et al. | 430/569 |
| 5,674,675 | 10/1997 | Inoue | 430/567 |

FOREIGN PATENT DOCUMENTS

| | | | |
|---|---|---|---|
| 0392092 A1 | 10/1990 | European Pat. Off. | G03C 1/04 |
| 0517961 A1 | 12/1992 | European Pat. Off. | G03C 1/04 |
| 0528476 A1 | 2/1993 | European Pat. Off. | G03C 1/04 |
| 653669 | 5/1995 | European Pat. Off. | G03C 1/005 |
| 677773 | 10/1995 | European Pat. Off. | G03C 1/005 |
| 767400 | 4/1997 | European Pat. Off. | G03C 1/005 |
| 7-72578 | 3/1995 | Japan | G03C 1/31 |
| 7-225439 | 8/1995 | Japan | G03C 1/035 |

*Primary Examiner*—Mark F. Huff
*Attorney, Agent, or Firm*—Breiner & Breiner

[57] ABSTRACT

A method is disclosed for the preparation of tabular silver halide emulsion grains rich in chloride and showing (100) parallel major and an average aspect ratio of at least 2.0 in silica sol as protective colloid binder. Important parameters are the addition modalities of the silica sol and the ratio of its amount to the amount of a costabilizing onium compound.

4 Claims, 4 Drawing Sheets

PREPARATION METHOD FOR (100) TABULAR SILVER HALIDE GRAINS RICH IN CHLORIDE IN SILICA SOL AS BINDER

This application claims the benefit of US Provisional Application No. 60/007,950 filed Dec. 4, 1995

DESCRIPTION

1. Field of the Invention

The present invention relates to the preparation of a new type of tabular grain silver halide emulsions rich in chloride.

2. Background of the Invention

High aspect ratio tabular grains exhibit several pronounced photographic advantages. Thanks to their particular morphology greater amounts of spectral sensitizers can be adsorbed per mole silver halide compared to classical globular grains. As a consequence such spectrally sensitized tabular grains show an improved speed-granularity relationship and a wide separation between their blue speed and minus blue speed. Sharpness of photographic images can be improved using tabular grains thanks to their lower light scattering properties again compared to conventional globular emulsion grains. In color negative materials the conventional sequence of the light sensitive layers can be altered and the yellow filter layer can be omitted. In developed black-and-white images high covering power is obtained even at high hardening levels; alternatively reduced silver halide coverages can be achieved if wanted resulting again in improved sharpness. In double coated radiographic materials the presence of tabular grains reduces the so-called cross-over which is the dominant factor for sharpness in such materials.

An emulsion is generally understood to be a "tabular grain emulsion" when tabular grains account for at least 50 percent of total grain projected area. A grain is generally considered to be a tabular grain when the ratio of its equivalent circular diameter (ECD) to its thickness (t) is at least 2. The equivalent circular diameter of a grain is the diameter of a circle having an area equal to the projected area of the grain. The term "intermediate aspect ratio tabular grain emulsion" refers to an emulsion which has an average tabular grain aspect ratio in the range of from 5 to 8. The term "thin tabular grain" is generally understood to be a tabular grain having a thickness of less than 0.2 $\mu$m.

The early patent disclosures on high aspect tabular grains, e.g. U.S. Pat. No. 4,434,226, U.S. Pat. No. 4,439,520, U.S. Pat. No. 4,425,425, U.S. Pat. No. 4,425,426, U.S. Pat. No. 4,433,048 and *Research Disclosure,* Vol. 225, Jan. 1983, Item 22534, are concerned with high sensitive silver bromide or silver iodobromide emulsions. However in a lot of photographic applications high sensitivity is of less importance. In these cases the use of chloride rich emulsions is advantageous thanks to their higher development and fixing rates. Typical examples include graphic arts contact materials, duplicating materials, hard-copy materials, diffusion transfer reversal materials and black-and-white or color print materials. So it would be interesting to try to combine the advantages of chloride rich emulsions with the advantages of tabular grain structure.

When using conventional precipitation conditions chloride rich emulsion grains show a cubic morphology with (100) crystal faces. It is known that to alter this crystallographic habit into a (111) habit so-called "growth modifiers" or "crystal habit modifiers" are required (see Klein and Moisar, in *Berichte der Bunsengesellschaft* Vol. 67 (4), p. 349–355, and Claes et al., *J. Photogr. Sci.* Vol. 21 (1973), p. 39–50). Typical examples of these modifiers include adenine, thiourea, hypoxanthine, benzimidazole and benzothiazole derivatives. The mechanism of the growth modifying action of adenine was studied in detail by Szucs in *J. Signal AM* Vol. 6 (1978) No 5 p. 381–405.

In view of the teachings on crystal growth modifiers for the preparation of conventional (111) silver chloride emulsions it is no wonder that patent applications emerged wherein crystal habit modifiers were described for use in the preparation of chloride rich tabular grains. So Maskasky U.S. Pat. No. 4,400,463 describes the preparation of a new crystallographic form of tabular silver halide grains rich in chloride by performing the precipitation in the presence of a special peptizer having a thioether linkage and an aminoazaindene growth modifier. Maskasky U.S. Pat. No. 4,713,323 discloses the preparation of thin tabular grains by a precipitation technique wherein oxidized gelatin is used. Tufano U.S. Pat. No. 4,804,621 describes a process for preparing chloride rich tabular grains in the presence of aminoazapyridine growth modifiers. EP 0 481 133 describes the presence of adenine-like compounds in the preparation of chloride rich tabular grains using conventional gelatin, and Maskasky U.S. Pat. No. 5,183,732 discloses similar compounds. Maskasky further describes triaminopyrimidines in U.S. Pat. No. 5,185,239, xanthine derivatives in U.S. Pat. No. 5,178,998, and other heterocyclic compounds in U.S. Pat. No. 5,178,997, all as growth modifiers in the preparation of chloride rich tabular emulsions.

As stated above the (111) major faces of tabular grain rich in chloride pose a problem of crystallographic stability. In EP 0 532 801 it was proposed to introduce a spectral sensitizer before the removal of the crystal growth modifier in a washing process in order to protect the crystallographic habit. In U.S. Pat. No. 5,221,602 the modifier is replaced after precipitation by a compound having a divalent sulphur group.

However, since the procedures mentioned above are cumbersome, methods were sought for the preparation of tabular grains rich in chloride having (100) major faces. However, the first publications on tabular grains bounded by such faces still concerned silver iodobromide emulsions. Bogg U.S. Pat. No. 4,063,951 reported the first tabular grain emulsions in which the tabular grains had parallel {100} major crystal faces. The tabular grains of Bogg exhibited square or rectangular major faces, thus lacking the threefold symmetry of conventional tabular grain {111} major crystal faces. In the sole example Bogg employed an ammoniacal ripening process for preparing silver bromoiodide tabular grains having aspect ratios ranging from 4:1 to 1:1.

Mignot U.S. Pat. No. 4,386,156 represents an improvement over Bogg in that the disadvantages of ammoniacal ripening were avoided in preparing a silver bromide emulsion containing tabular grains with square and rectangular major faces. Mignot specifically requires ripening in the absence of silver halide ripening agents other than bromide ion (e.g., thiocyanate, thioether or ammonia).

Endo and Okaji, "An Empirical Rule to Modify the Habit of Silver Chloride to form Tabular Grains in an Emulsion", *The Journal of Photographic Science,* Vol. 36, pp. 182–188, 1988, discloses silver chloride emulsions prepared in the presence of a thiocyanate ripening agent. Emulsion preparations by the procedures disclosed has produced emulsions containing a few tabular grains within a general grain population exhibiting mixed {111} and {100} faces.

Mumaw and Haugh, "Silver Halide Precipitation Coalescence Processes", Journal of Imaging Science, Vol. 30, No.

5, September/October, 1986, pp. 198–299, is essentially cumulative with Endo and Okaji, with section IV-B being particularly pertinent.

In EP 0 534 395 Brust et al. disclose the first chloride rich tabular emulsion and a process for preparing it wherein the tabular grain fraction showing (100) major faces is significant. A process is disclosed for preparing silver halide emulsions containing tabular grains bounded by {100} major faces of which the tabular grains bounded by {100} major faces form a portion accounting for 50 percent of total grain projected area selected on the criteria of adjacent major face edge ratios of less than 10 and thicknesses of less than 0.3 μm and having higher aspect ratios than any remaining tabular grains satisfying these criteria (1) have an average aspect ratio of greater than 8 and (2) internally at their nucleation site contain iodide and at least 50 mole percent chloride, comprised of the steps of (1) introducing silver and halide salts into a dispersing medium so that nucleation of the tabular grains occurs in the presence of iodide with chloride accounting for at least 50 mole percent of the halide present in the dispersing medium and the pCl of the dispersing medium being maintained in the range of from 0.5 to 3.5 and (2) following nucleation completing grain growth under conditions that maintain the {100} major faces of the tabular grains.

Further improvements and variations on the teachings of tabular (100) emulsions rich in chloride were described in U.S. Pat. No. 5,292,632, EP 0 569 971, U.S. Pat. No. 5,275,930, EP 0 616 255, U.S. Pat. No. 5,264,337, U.S. Pat. No. 5,310,635, EP 0 617 317, EP 0 617 318, EP 0 617 320, EP 0 617 321, EP 0 617 325, WO 94/22051, WO 94/22054, EP 0 618 492, EP 0 618 493, U.S. Pat. No. 5,314,798, U.S. Pat. No. 5,356,764 and EP 0 653 659.

In the past several patent publications have dealt with silver halide emusions and methods of their praparation wherein the colloidal binder in the dispersing medium was colloidal silica sol in replacement of or in addition to gelatin. It appeared that emulsions of this type showed a significant improvement for pressure sensitivity once chemically ripened and coated as a layer in a photographic element. These disclosures include EP 0 392 092, EP 0 517 092 and EP 0 528 476. In European patent application, Appl. No. 94200933 tabular grains are disclosed prepared in a dispersing medium having colloidal silica sol as binder. However, the actual examples are limited to tabular AgBrI emulsions having (111) major faces.

The present invention extends the teachings on tabular silver halide grains rich in chloride and prepared in a silica sol medium.

It is an object of the present invention to provide a silver halide tabular grain emulsion, rich in chloride and showing a stable crystallographic habit.

It is a further object of the present invention to provide a tabular grain emulsion that, after chemical ripening and coating in a layer of a photographic element, will show an improvement for resistance against pressure marks.

It is still a further object of the present invention to provide a process for the preparation of such tabular emulsions.

SUMMARY OF THE INVENTION

The objects of the present invention are realized by providing a process for the preparation of a radiation sensitive silver halide emulsion comprising colloidal silica sol as the substantially sole binder, and containing at least 50 mole % of chloride, based on total amount of silver halide, in which more than 50% of the total projected area of the grain population is accounted for by tabular grains bounded by parallel major faces lying in (100) crystallographic planes and having an adjacent edge ratio of less than 10, and wherein the average aspect ratio of the (100) tabular grain poulation is at least 2, said process comprising the following steps:

(a) a nucleation step performed by introducing into a vessel silver and halide salt solutions, wherein chloride ion accounts for at least 50 mole % and iodide ion accounts for at most 10 mole % of the totality of halide, while the pCl of the medium is maintained between 0.5 and 3.0, (b) a physical ripening step, (c) at least one growth step performed by introducing silver and halide salt solutions as defined in step (a) at increasing flow rates into the vessel, thereby maintaining the pCl at a value between 0.5 and 3.0.

characterized in that colloidal silica sol and an onium compound are added both before or during said nucleation step (a) and during said physical ripening step (b) or solely during said physical ripening step (b) in such a way that the amount of silica sol added during said step (b) ranges from 10 to 100% of the total amount of silica sol added.

In a most preferred embodiment the amount of silica sol added during physical ripening step (b) ranges from 40 to 60% of the total amount of silica sol added, and the ratio of the total amount of onium compound added to the total amount of silica sol added ranges from 0.07 to 0.15.

DETAILED DESCRIPTION OF THE INVENTION

Figure 1:
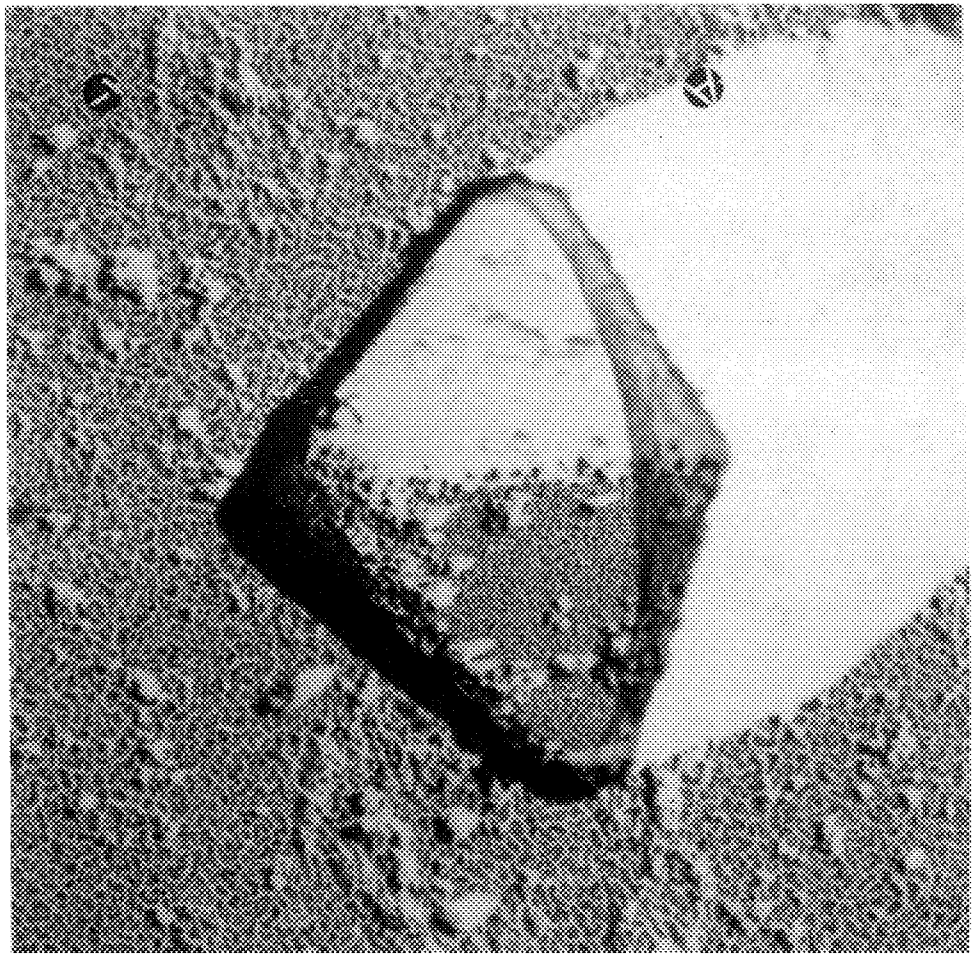
FIGS. 1 and 2 are illustrations of twinned crystals (see page 13).

Silica sols used as a protective colloid in the preparation of silver halide emulsions comprising tabular grains according to this invention are commercially available such as the "Syton" silica sols (trademarked products of Monsanto Inorganic Chemicals Div.), the "Ludex" silica sols (trademarked products of du Pont de Nemours & Co., Inc.), the "Nalco" and "Nalcoag" silica sols (trademarked products of Nalco Chemical Co), the "Snowtex" silica sols of Nissan Kagaku K.K. and the "Kieselsol, Types 100, 200, 300, 500 and 600" (trademarked products of Bayer AG). Particle sizes of the silica sol particles are in the range from 3 nm to 30 μm. Smaller particles in the range from 3 nm to 0.3 μm are preferred as the coverage degree per gram of silica sol that can be achieved will be higher and as the protective action of the colloidal silica will be more effective.

During the precipitation of silver halide crystals in colloidal silica as a protective colloid onium compounds as co-stabilizers for the colloidal silica are required. It has been found that before the start of the precipitation of the silver halide tabular crystals in the presence of colloidal silica, aggregates of colloidal silica together with onium co-stabilizing compounds may be present. Said aggregates are acting analogously as a protective colloid for the silver halide nuclei formed, just as, e.g., gelatin.

As onium compounds the following compounds, disclosed in EP-0 392 092 and represented by the following general formulae can be used:

$$A^+X^-$$

wherein $X^-$ represents an anion and $A^+$ represents an onium ion selected from any of the following general formulae:

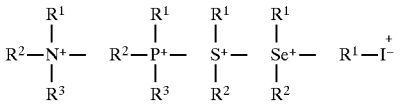

and wherein:

each of $R_1$ and $R_3$ (same or different) represents hydrogen (except for ammonium), an alkylgroup, a substituted alkyl group, a cycloalkyl group, an aryl group or a substituted aryl group, $R_2$ represents any of the said groups represented by $R_1$ and $R_3$ or the atoms necessary to close a heterocyclic nucleus with either $R_1$ or $R_3$, the said onium ion being linked 1) to a polymer chain, or 2) via a bivalent organic linking group e.g., —O—, —S—, —$SO_2$—, etc., to any other of such onium structure, or 3) directly to any of the groups represented by $R_1$.

A preferred onium compound is $(phenyl)_3$-$P^+$—$CH_2$—$CH_2OH.Cl^-$.

Other suitable examples of onium compounds are disclosed in U.S. Pat. No. 3,017,270. In said specification examples are mentioned of trialkyl sulfonium salts, polysulfonium salts, tetraalkyl quaternary ammonium salts, quaternary ammonium salts in which the quaternary nitrogen atom is a part of a ring system, cationic polyalkylene oxide salts including e.g. quaternary ammonium and phosphonium and bis-quaternary salts.

Furtheron, onium salt polymers wherein the onium group may be, e.g., an ammonium, excluding inorganic ammonium compounds, phosphonium or sulphonium group, are disclosed in U.S. Pat. No. 4,525,446. Said onium compounds act as effective stabilisers of the colloidal stability of silver halide tabular crystals covered with silica, provided that, according to this invention, an appropriate amount is added to the reaction vessel versus the amount of silica present.

The partition between steps (a) and (b) of the amounts of silica sol added is of great importance for the successful practice of the present invention. During the physical ripening step 10 to 100% of the final amount must be added. When more than 90% of the total silica sol is added before or during the nucleation step an insufficient number of (100) tabular grains will be obtained certainly not accounting for 50% of the total projected grain area. In a preferred embodiment the amount of silica sol is about equally divided: 40 to 60% in step (a) and 60 to 40% in step (b) .

For each partition ratio of the silica sol added there is also an optimal ratio for the amount of costabilizing onium compound to silica sol. When the silica sol is approximately equally divided then the ratio of the total amount of onium compound added to the total amount of silica added is preferably comprised between 0.07 and 0.15.

Of the total amount of silver nitrate less than 10% by weight and, more preferably, 0.5% to 5.0% is added during the nucleation step which consists preferably of an addition by means of the double-jet method of silver nitrate and halide salts at a constant flow rate. The pCl of the medium must be established and maintained at a value between 0.5 and 3.0.

The growth step is performed by adding simultaneously silver salt and halide solutions at increasing flow rates. Linearly increasing flow rates are preferred. During said growth step the pCl must be maintained between 0.5 and 3.0. In principle more than one growth step can be performed. It is important to avoid renucleation during the growth step by controlling the preferred increasing rate of addition of the silver nitrate and the halide salts to make the distribution predictable of the emulsion crystals comprising tabular silica silver halide.

The photographic emulsions comprising silver halide tabular crystals covered with silica particles, according to the present invention, may have a homogeneous or a heterogeneous halide distribution within the crystal volume. A heterogeneous halide distribution may be obtained by application of growth steps having a different halide composition or by conversion steps, e.g. by addition of halide ions that provide less soluble silver salts, onto existing tabular cores. In the case of a heterogenous distribution of halide ions a multilayered grain structure is obtained. Obviously the tabular form has to be maintained in this case, in order to get silica tabular emulsion crystals in accordance with this invention.

The crystals may further be doped with whatever a dope, as e.g. with $Rh^{3+}$, $Ir^{4+}$, $Cd^{2+}$, $Zn^{2+}$, $Pb^{2+}$.

During precipitation grain growth restrainers or accelerators may be added to obtain crystals with a preferred average crystal size between 0.05 and 5 $\mu$m. Examples of grain growth accelerators are compounds carrying e.g. a thioether function.

The light-sensitive emulsion comprising silver halide tabular crystals with silica as protective colloid, prepared in accordance with the present invention is, after redispersion, a so-called primitive emulsion. However, said emulsion can be chemically sensitized as described i.a. "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in this literature chemical sensitization can be carried out by effecting the ripening in the presence of small amounts of compounds containing sulphur e.g. thiosulphate, thiocyanate, thioureas, sulphites, mercapto compounds, and rhodanines. The emulsions can be sensitized also by means of gold-sulphur ripeners or by means of reductors e.g. tin compounds as described in GB-A 789,823, amines, hydrazine derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitization methods or a combination thereof can be used. A mixture can also be made of two or more separately precipitated emulsions being chemically sensitized before mixing them.

The light-sensitive emulsion comprising silver halide tabular crystals with silica as a protective colloid, prepared in accordance with the present invention, may be spectrally sensitized with methine dyes such as those described by F.

M. Hamer in "The Cyanine Dyes and Related Compounds". 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in the already cited Research Disclosure Item 22534.

According to this invention chemical ripening is performed before, during or after spectral sensitization. In classical emulsion preparation spectral sensitization traditionally follows the completion of chemical sensitization. However, in connection with tabular grains, it is specifically considered that spectral sensitization may occur simultaneously with or may even precede completely the chemical sensitization step: the chemical sensitization after spectral sensitization is believed to occur at one or more ordered discrete sites of tabular grains. This may also be done with the emulsions of the present invention.

Before chemical sensitizaton and or before coating extra silica sol can be added to the tabular (100) emulsions as protective colloid. Also the conventional binder gelatin can be added. The final ratio of the amount of total binder (silica+gelatin) to silver, expressed as silver nitrate, is then preferably comprised between 0.2 and 1.0, most preferably between 0.3 and 0.6.

The finished photographic can further contain the well-known conventional ingredients such as antifoggants, stabilizers, wetting agents, UV absorbers, antistatics, plasticizers, development accelerators antihalation dyes, colour couplers, filter dyes, spacing agents, hardeners, etc.

The photographic material can contain several non-light sensitive layers, e.g. a protective antistress topcoat layer, one or more backing layers, and one or more intermediate layers optionally containing filter- or antihalation dyes that absorb scattering light and thus promote the image sharpness.

The photographic silica tabular silver halide emulsions can be used in various types of photographic elements such as i.a. in photographic elements for so-called amateur and professional photography, for graphic arts, diffusion transfer reversal photographic elements, low-speed and high-speed photographic elements, X-ray materials, micrografic materials etc.

The support of the photographic material may be opaque or transparent, e.g. a paper support or resin support. When a paper support is used preference is given to one coated at one or both sides with an Alpha-olefin polymer, e.g. a polyethylene layer which optionally contains an antihalation dye or pigment. It is also possible to use an organic resin support e.g. cellulose nitrate film, cellulose acetate film, poly(vinyl acetal) film, polystyrene film, poly(ethylene terephthalate) film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material containing tabular grains prepared according to the present invention can be image-wise exposed by any convenient radiation source in accordance with its specific application.

Of course processing conditions and composition of processing solutions are dependent from the specific type of photographic material in which the tabular grains prepared according to the present invention are applied.

Embedded in a photographic material the silver halide tabular crystals prepared according to this invention are surrounded by colloidal silica, serving as an extremely useful protective colloid. An especially advantageous effect resulting therefrom is the better resistance of the coated material to pressure phenomena. Emulsion layers in accordance with the present invention, and more particularly thin emulsion layers, are showing remarkable improvements concerning both resistance to stress and rapid processability compared to conventional emulsions prepared in gelatinous medium. As the ratio by weight of gelatin to silver halide decreases more pronounced pressure marks can be expected. Nevertheless as a result of the protective action of the adsorbed silica to the silver halide crystal surface much less pressure sensitivity appears, which cannot be expected to the same extent if silica is added as coating additive as has been suggested, e.g., in JP-A's 05-053 230, 05-088 285, 06-332095 and 07-36165.

A decreased pressure sensitivity for the materials coated from silver halide emulsions according to this invention is attained in various processing conditions and should be recognized as an exceptional advantage offered by the tabular (100) silver halide emulsion crystals rich in chloride and prepared in silica sol as protective colloid binder.

EXAMPLES

Example 1

This example was designed to illustrate the influence of the concentration of the colloidal silica and the concentration of the onium compound during the precipitation on the final crystal structure of the precipitated silver halide.

A silver iodochloride emulsion was precipitated as follows: a 2280 mL solution containing x1 g of 'Kieselsol 500' (Bayer AG) and y1 g of the co-stabilizing phosphonium compound $(Phenyl)_3\text{-}P^+\text{—}CH_2\text{—}CH_2OH.Cl^-$ was provided in a stirred reaction vessel. The pCl was adjusted with KCl to a value of 1.0, the pH was adjusted to 3.0 and the reaction vessel was maintained at 45° C.

While this solution was vigorously stirred, 24 mL of a 2.94M silver nitrate solution and 24 mL of a 2.925M potassium chloride and 0.015M potassium iodide solution were added simultaneously at a rate of 48 mL/min each.

The mixture was then held 20 minutes while raising the temperature to 70° C. so that the emulsion underwent a physical ripening step. Then a 750 mL solution containing x2 (=36−x1) g of 'Kieselsol 500' and $y^2$ g of the co-stabilizing phosphonium compound were added and the pH was adjusted to 3.0. The mixture was then again held for 5 minutes. Then a 2.94M silver nitrate solution and a 2.925M potassium chloride and 0.015M potassium iodide solution were added simultaneously at a rate during 77 minutes and 36 seconds starting at a flow rate of 4 mL/min and linearly increasing the flow rate to an end value of 16 mL/min with the pCl being maintained at 1.4.

Figure 2:
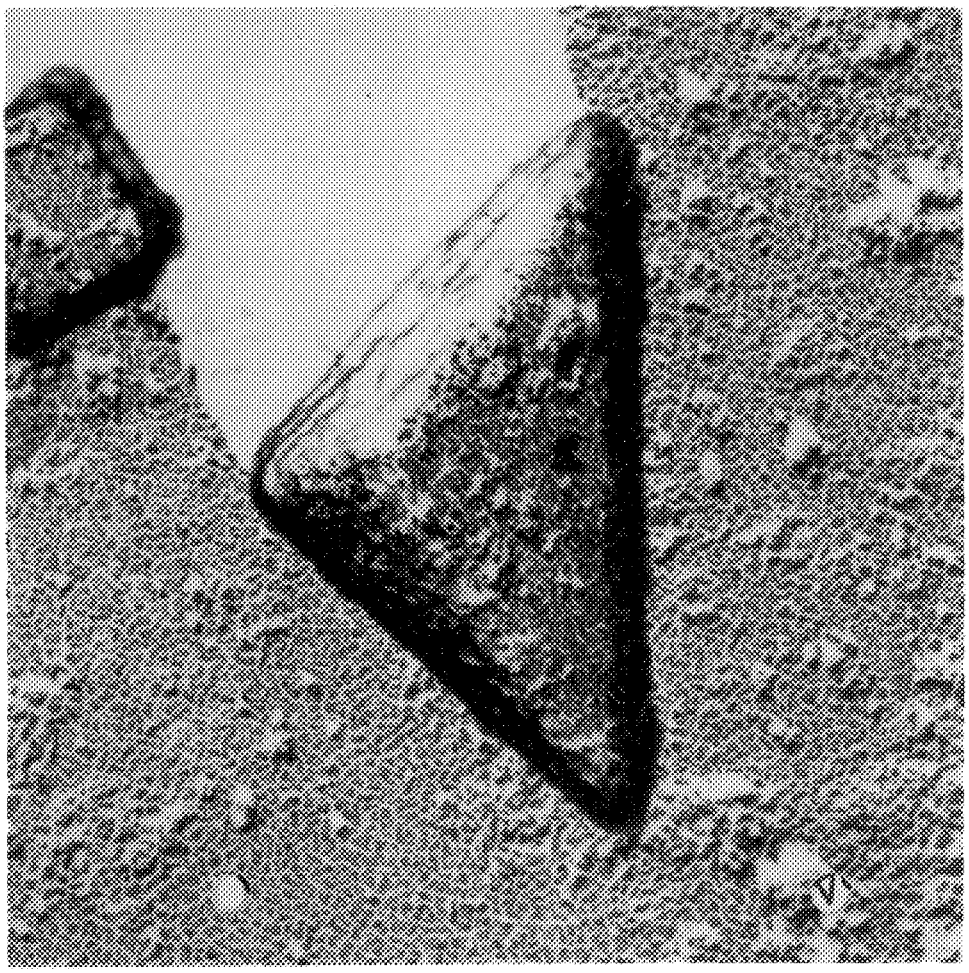

The resulting emulsions contained 0.5 mole percent iodide, based on silver. The emulsions were statistically analysed towards their crystal structures using the transmission electron micrographs of the shadowed replicas. The results for emulsions A to N are shown in table I, where x1 refers to the amount of Kieselsol added in g before the start of the nucleation step;

y1 refers to the amount of onium compound added in g before the start of the nucleation step;

x2 refers to the amount of Kieselsol added in g at the end of the physical ripening before the growth step;

y2 refers to the amount of onium compound added in g at the end of the physical ripening before the growth step;

%<0.3 μm refers to the percentage of the crystal population which shows an average projected diameter of less then 0.3 μm. These small crystals were neglected in the morphological analysis;

% cubic refers to the percentage of cubic crystals present in the crystal population;

% [100] tab refers to the percentage of [100] tabular (rectangular) crystals present in the crystal population. The aspect ratio is at least 2.0;

AR refers to the mean aspect ratio of the [100] tabular crystals and is defined as the mean ECD (Equivalent Circular Diameter) divided by the mean thickness of the crystal;

% twins refers to the percentage of single twinned crystals. Both single [111] twinned crystals (see FIG. 1) and single [311] twinned (see FIG. 2) were present;

% [111] tab refers to the percentage of [111] double twinned tabular (hexagonal) crystals present in the crystal population. The aspect ratio is at least 2.

% undef refers to the percentage of undefined crystal structures present in the crystal population;

# crystals refers to the amount of crystals counted and classified with an average projected diameter >0.3 μm;

TABLE I

| Em | x1 | y1 | x2 | y2 | (y1 + y2)/(x1 + x2) | % <0.3 μm | % cubic | % [100] tab | AR | % twins | % [111] tab | % undef | # crystals |
|---|---|---|---|---|---|---|---|---|---|---|---|---|---|
| A | 36 | 1.80 | 0 | 0 | 0.05 | 70 | — | — | — | — | — | 100 | 10 |
| B | 36 | 3.60 | 0 | 0 | 0.10 | 75 | 48 | 14 | 2 | 28 | 3 | 7 | 111 |
| C | 36 | 5.40 | 0 | 0 | 0.15 | 5 | 79 | 7 | 2 | 6 | 3 | 5 | 98 |
| D | 36 | 7.20 | 0 | 0 | 0.20 | 60 | 48 | 2 | 2 | 10 | 8 | 32 | 86 |
| E | 27 | 2.70 | 9 | 0.90 | 0.10 | 67 | 37 | 19 | 4 | 42 | — | 2 | 91 |
| F | 27 | 4.05 | 9 | 1.35 | 0.15 | 15 | 66 | 21 | 3 | 5 | — | 8 | 110 |
| G | 27 | 5.40 | 9 | 1.80 | 0.20 | 10 | 74 | 13 | 2 | 5 | — | 8 | 149 |
| H | 18 | 0.90 | 18 | 0.90 | 0.05 | 90 | — | — | — | — | 50 | 50 | 6 |
| I | 18 | 1.80 | 18 | 1.80 | 0.10 | 22 | 46 | 13 | 5 | 31 | — | 10 | 240 |
| J | 18 | 2.70 | 18 | 2.70 | 0.15 | 7 | 48 | 24 | 3 | 28 | — | — | 135 |
| K | 18 | 3.60 | 18 | 3.60 | 0.20 | 18 | 47 | 33 | 2 | 20 | — | — | 166 |
| L | 9 | 0.90 | 27 | 2.70 | 0.10 | 10 | 60 | 10 | 2 | 23 | — | 7 | 96 |
| M | 9 | 1.35 | 27 | 4.05 | 0.15 | 58 | 51 | 12 | 2 | 32 | — | 5 | 94 |
| N | 9 | 1.80 | 27 | 5.40 | 0.20 | 4 | 26 | 46 | 2 | 28 | — | — | 120 |

As can be concluded from table I, the total amount of the onium compound and the moment of addition of the Kieselsol and the onium compound has a big influence on the final crystal structure:

the more onium compound is used in the beginning of the precipitation, the less [100] tabular crystals and single twins are formed and the more [111] tabular crystals and undefined crystal strucures are formed (compare emulsions B,C,D);

the less onium compound is used in the beginning of the precipitation for the high total amount of the onium compound, the more [100] tabular crystals are formed, the more single twins are formed but the less undefined crystal structures are formed (compare emulsions D,G, K,N);

the aspect ratio of the formed [100] tabular crystals can be raised if the lower amount of the onium compound is distributed equally at the beginning of the precipitation and at the beginning of the growth step (compare emulsions B,E,I).

Example 2

This example illustrates an optimization of the results of example 1 towards more [100] tabular crystals with a higher aspect ratio.

As was shown in example 1, a total amount of 3.6 g of the onium compound, for which 1.8 g was added at the beginning of the precipitation and 1.8 g was added at the beginning of the growth step, gave the maximum aspect ratio, although very few [100] tabular crystals were found in the population (emulsion I). We used this as a starting point for the optimization. It was found that more [100] tabular could be formed when the following precipitation settings were used:

Emulsion O (Invention)

A tabular silver iodochloride emulsion was precipitated as follows: a 2280 mL solution containing 18 g of 'Kieselsol 500' and 1.8 g of the co-stabilizing phosphonium compound $(Phenyl)_3\text{-}P^+\text{—}CH_2\text{—}CH_2OH.Cl^-$ was provided in a stirred reaction vessel. The pCl was adjusted with KCl to a value of 2.0, the pH was adjusted to 6.0 and the reaction vessel was maintained at 45° C.

While this solution was vigorously stirred, 24 mL of a 2.94M silver nitrate solution and 24 mL of a 2.925M potassium chloride and 0.015M potassium iodide solution were added simultaneously at a rate of 48 mL/min each.

The mixture was then held 20 minutes while raising the temperature to 70° C. Then a 750 mL solution containing 18 g of 'Kieselsol 500' and 1.8 g of the co-stabilizing phosphonium compound was added and the pH was adjusted to 3.0. The mixture was then again held for 5 minutes. Then a 2.94M silver nitrate solution and a 2.925M potassium chloride and 0.015M potassium iodide solution were added simultaneously at a rate during 77 minutes and 36 seconds starting at a flow rate of 4 mL/min and linearly increasing the flow rate to an end value of 16 mL/min with the pCl being maintained at 1.4.

In the resulting high chloride [100] tabular grain emulsion tabular grains accounted for 50 percent of the total grain projected area with an average aspect ratio of about 4.

Figure 3:
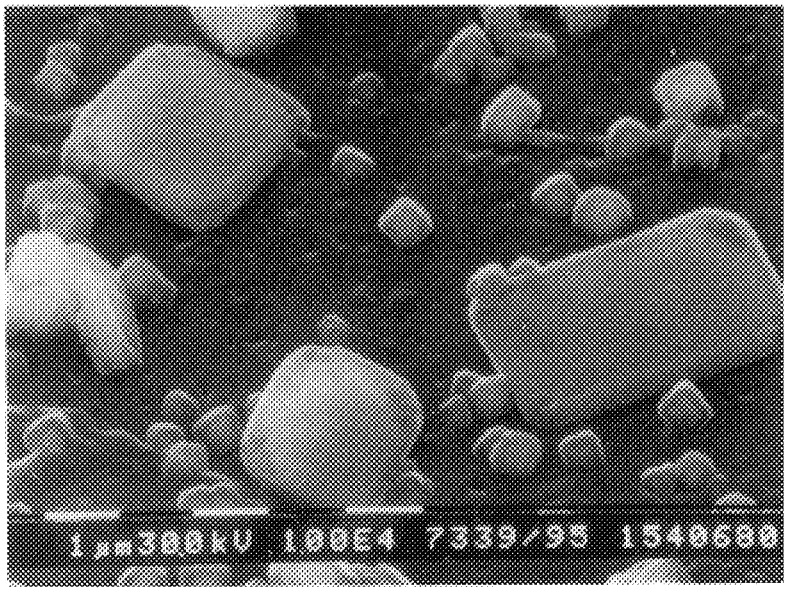
FIG. 3 is a transmission electron micrograph of the emulsion prepared in Example 2.

FIG. 3 shows a transmission electron micrograph of the resulting emulsion.

Example 3

This example demonstrates that the transcription of the precipitation formula in silica sol to a precipitation formula in gelatine is not obvious.

Emulsion P. (Comparative emulsion in gelatine)

A silver iodochloride emulsion was precipitated according to the formula of Emulsion O with the modification that silica sol was replaced by gelatin as binder and that no onium compound was present:

A 2280 mL solution containing 20 g of gelatin was provided in a stirred reaction vessel. The pCl was adjusted with KCl to a value of 2.0, the pH was adjusted to 6.0 and the reaction vessel was maintained at 45° C.

While this solution was vigorously stirred, 24 mL of a 2.94M silver nitrate solution and 24 mL of a 2.925M potassium chloride and 0.015M potassium iodide solution were added simultaneously at a rate of 48 mL/min each.

The mixture was then held 20 minutes while raising the temperature to 70° C. Then the pH was adjusted to 3.0 and a 2.94M silver nitrate solution and a 2.925M potassium chloride and 0.015M potassium iodide solution were added simultaneously at a rate during 77 minutes and 36 seconds starting at a flow rate of 4 mL/min and linearly increasing the flow rate to an end value of 16 mL/min with the pCl being maintained at 1.4.

Figure 4:
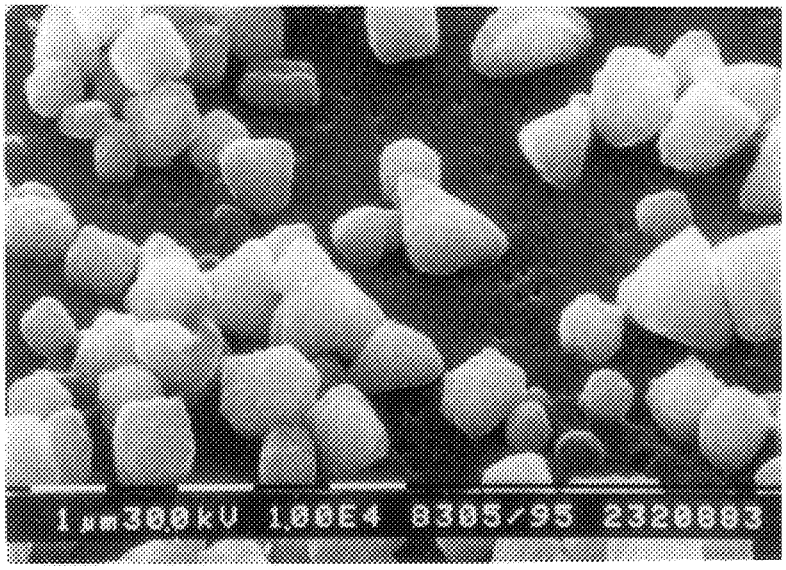
FIG. 4 is a transmission electron micrograph of the emulsion prepared in Example 3.

In the resulting high chloride emulsion no [100] tabular grains were found as is shown in the transmission electron micrograph of the resulting emulsion in FIG. 4.

Example 4

This example demonstrates that the transcription of a precipitation formula in gelatin for [100] tabular crystals to a precipitation formula in silica sol for [100] tabular crystals is not obvious.

Emulsion Q

A 1600 mL solution containing 10 g of gelatin was provided in a stirred reaction vessel. The pCl was adjusted with KCl to a value of 1.0, the pH was adjusted to 6.0 and the reaction vessel was maintained at 50° C.

While this solution was vigorously stirred, 24 mL of a 2.94M silver nitrate solution and 24 mL of a 2.925M potassium chloride and 0.015M potassium iodide solution were added simultaneously at a rate of 48 mL/min each.

The mixture was then held 20 minutes while raising the temperature to 70° C. Then a 2.94M silver nitrate solution and a 2.925M potassium chloride and 0.015M potassium iodide solution were added simultaneously at a rate during 77 minutes and 36 seconds starting at a flow rate of 4 mL/min and linearly increasing the flow rate to an end value of 16 mL/min with the pCl being maintained at 1.4.

Figure 5:
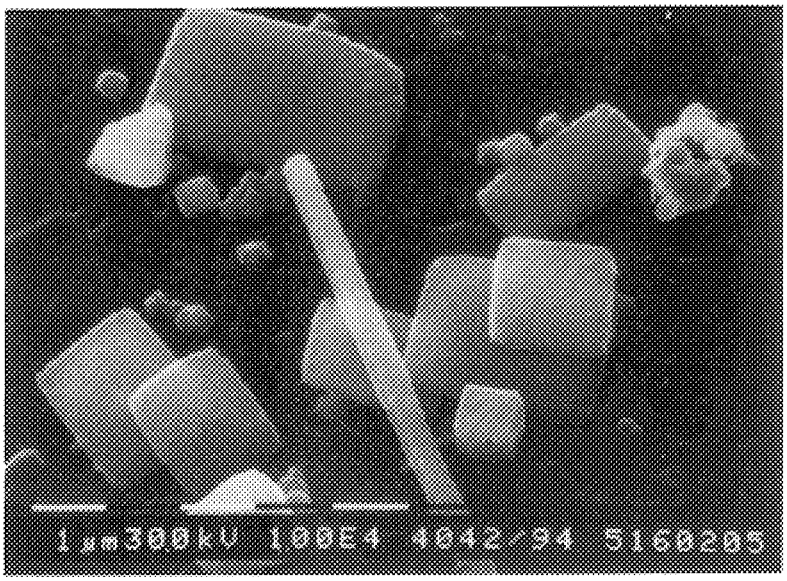
FIG. 5 is a transmission electron micrograph of emulsion Q of Example 4.

In the resulting high chloride [100] tabular grain emulsion tabular grains accounted for 80 percent of the total grain projected area with an average aspect ratio of about 4. FIG. 5 shows an transmission electron micrograph of the resulting emulsion.

Emulsion R

A 1600 mL solution containing 10 g of "Kiezelsol 500" and 1 g of the co-stabilizing phosphonium compound $(Phenyl)_3\text{-}P^+\text{—}CH_2\text{—}CH_2OH.Cl^-$ was provided in a stirred reaction vessel. The pCl was adjusted with KCl to a value of 1.0, the pH was adjusted to 6.0 and the reaction vessel was maintained at 50° C.

While this solution was vigorously stirred, 24 mL of a 2.94M silver nitrate solution and 24 mL of a 2.925M potassium chloride and 0.015M potassium iodide solution were added simultaneously at a rate of 48 mL/min each.

The mixture was then held 20 minutes while raising the temperature to 70° C. Then a 2.94M silver nitrate solution and a 2.925M potassium chloride and 0.015M potassium iodide solution were added simultaneously at a rate during 77 minutes and 36 seconds starting at a flow rate of 4 mL/min and linearly increasing the flow rate to an end value of 16 mL/min with the pCl being maintained at 1.4.

Figure 6:
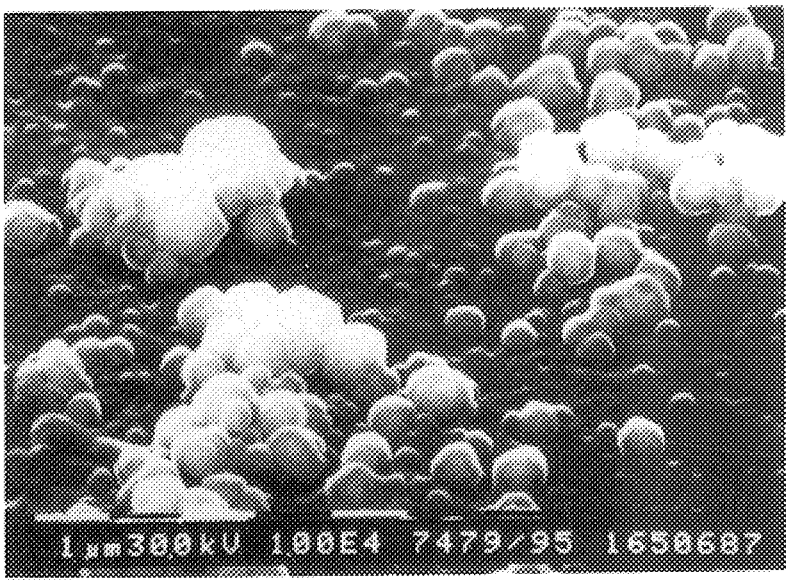
FIG. 6 is a transmission electron micrograph of emulsion R of Example 4.

In the resulting high chloride emulsion no [100] tabular grains were found as is shown in the transmission electron micrograph of the resulting emulsion in FIG. 6.

We claim:

1. Process for the preparation of a radiation sensitive silver halide emulsion comprising silver halide grains comprising a binder consisting essentially of colloidal silica sol and containing at least 50 mole % of chloride in said silver halide grains, based on the total amount of silver halide, in which more than 50% of the total projected area of the grain population is accounted for by tabular grains bounded by parallel major faces lying in (100) crystallographic planes and having an adjacent edge ratio of less than 10, and wherein the average aspect ratio of the (100) tabular grain population is at least 2, said process comprising:

(a) a nucleation step performed by introducing into a vessel silver and halide salt solutions, wherein chloride ion accounts for at least 50 mole % and iodide ion accounts for at most 10 mole % of the totality of halide, while the pCl is maintained between 0.5 and 3.0, (b) a physical ripening step, (c) at least one growth step performed by introducing silver and halide salt solutions as defined in step (a) at increasing flow rates into said vessel, thereby maintaining the pCl at a value between 0.5 and 3.0 and wherein a colloidal silica sol and an onium compound are added both before or during said nucleation step (a) and during said physical ripening step (b) such that the amount of silica sol added during said step (b) ranges from 40 to 60% of the total amount of silica sol added and wherein the ratio of the total amount of onium compound added to the total amount of silica sol added ranges from 0.07 to 0.15.

2. Process according to claim 1 wherein said onium compound is a phosphonium compound.

3. Process according to claim 2 wherein said phosphonium compound has the formula $(phenyl)_3\text{-}P^+\text{—}CH_2\text{—}CH_2OH.Cl^-$.

4. Process according to claim 1 wherein the average particle size of said silica sol is comprised between 0.003 and 0.3 $\mu$m.

* * * * *